US007208665B2

(12) United States Patent
Schleske

(10) Patent No.: US 7,208,665 B2
(45) Date of Patent: Apr. 24, 2007

(54) SOUNDBOARD OF COMPOSITE FIBRE MATERIAL CONSTRUCTION FOR ACOUSTIC STRINGED INSTRUMENTS

(76) Inventor: Martin Schleske, Grubmühl 22, Stockdorf (DE) 82131

( * ) Notice: Subject to any disclaimer, the term of this patent is extended or adjusted under 35 U.S.C. 154(b) by 0 days.

(21) Appl. No.: 11/195,142

(22) Filed: Aug. 2, 2005

(65) Prior Publication Data

US 2006/0042447 A1 Mar. 2, 2006

(30) Foreign Application Priority Data

Aug. 24, 2004 (DE) ..... 10 2004 041 010

(51) Int. Cl.
*G10D 1/02* (2006.01)

(52) U.S. Cl. ..... 84/275

(58) Field of Classification Search ..... 84/267, 84/290, 291, 275, 311
See application file for complete search history.

(56) References Cited

U.S. PATENT DOCUMENTS 4,353,862 A 10/1982 Kaman, II
4,408,516 A * 10/1983 John ..... 84/275
6,750,385 B1 * 6/2004 Sugden ..... 84/274

FOREIGN PATENT DOCUMENTS

| | | |
|---|---|---|
| DE | 20113495 | 12/2001 |
| EP | 1 182 642 A2 | 8/2001 |
| WO | WO91/00589 | 1/1999 |

* cited by examiner

*Primary Examiner*—Kimberly Lockett
(74) *Attorney, Agent, or Firm*—John K. McCulloch

(57) ABSTRACT

The invention relates to a soundboard of composite fibre material construction for acoustic stringed instruments, comprising a core plate and a fibre laminate which is provided on at least one of the two outer faces of the core plate and is composed of long fibres embedded in a carrier material, the core plate having a lower average density than the fibre laminate. In this case a part of the core plate including the two end regions of the central zone of the core plate has a longitudinal compression strength which is greater than the longitudinal compression strength of the remaining part of the core plate. In this way a construction is achieved which is particularly stable under compression whilst at the same time having an improved acoustic quality.

9 Claims, 5 Drawing Sheets

SOUNDBOARD OF COMPOSITE FIBRE MATERIAL CONSTRUCTION FOR ACOUSTIC STRINGED INSTRUMENTS

The invention relates to a soundboard of composite fibre material construction for acoustic stringed instruments, in particular for use as at least one of the two soundboards of the resonant body of bowed stringed instruments, comprising a core plate and a fibre laminate which is provided on at least one of the two outer faces of the core plate and is composed of long fibres embedded in a carrier material, the core plate having a lower average density than the fibre laminate.

In recent years attempts have been made to produce the soundboards of acoustic stringed instruments in composite fibre material construction. Structures of composite fibre material construction generally consist of long fibres which are oriented in specific directions and a carrier material which is generally a thermosetting or thermoplastic plastics material, in particular an epoxy resin system.

The previous efforts to produce soundboards of composite fibre material construction are aimed without exception at copying as well as possible the acoustic characteristics of the wood which is to be substituted. Thus U.S. Pat. No. 4,353,862 A shows a guitar soundboard in which a fibreglass fabric impregnated with polyester resin is applied to a wood sheet. In this case the weft threads of the fibreglass fabric extend approximately parallel to the grain of the wood sheet and the warp threads of the fibreglass fabric extend approximately transversely with respect to the grain of the wood sheet.

EP 0 433 430 A relates to a soundboard of a bowed stringed instrument in which a plurality of sheets are disposed one above the other, each of which comprises long fibres which are embedded in a carrier material. In this case in each sheet the long fibres extend parallel to one another, whilst the fibre directions of the individual sheets differ from one another. The top and bottom cover sheet of this soundboard are made from wood in order to reduce the overall density of the soundboard and to achieve the desired damping properties.

The subject matter of EP 1 182 642 A1 is also a soundboard consisting of three sheets in which the middle sheet forms a core plate of lower density, whilst the two outer sheets have a fibre laminate comprising long fibres which are embedded in a carrier material. In this case the fibre laminate is of single-layer and at the same time multidirectional construction. In a variant of this soundboard the central part of the soundboard is reinforced in the cross direction by appropriately selected orientation of the multidirectional fibre laminate.

Finally, from DE 201 13 495 U1 a soundboard of composite fibre material construction is known in which the core plate has recesses in the two lower and upper cheeks in order to reduce the vibrating mass.

The principal aim of all these attempts is to achieve a more favourable ratio of mass than has been provided in the traditional soundboards made from solid wood. Particularly in the case of soundboards for bowed stringed instruments critical problems of strength occur due to the high string tension (almost 300 Newtons in the case of the violin) acting in the longitudinal direction when the soundboard is constructed according to the sandwich principle from a core plate of low density and two fibre laminates provided on the two outer faces of the core plate. These problems may be explained in greater detail with reference to FIGS. 1*a* and 1*b*:

FIG. 1*a* shows a bowed stringed instrument (for example a violin) quite schematically in a side view. FIG. 1*b* illustrates the upper end region 15 of the top plate, i.e. the upper soundboard 11, on an enlarged scale. The tensile stress of the strings 10 acts on the one hand via the bridge 9 vertically on the upper soundboard 11 as a compressive force in the direction −Z and on the other hand as a compressive force F in the direction −Y on the base of the neck 13 and as a counter-force −F in the direction Y on the saddle 12 of the body. As a result a compression of the upper soundboard 11 takes place in the direction Y, and the usual low-density core materials are not very suitable for absorbing high compression forces. If the compression force acting on the soundboard 11 due to the string tension in the longitudinal direction Y exceeds a critical value then there is a danger in the rising end portions 14, 15 of buckling of the soundboard as is indicated schematically in FIG. 1*b* for the end region 15: over the cross-section of the board thickness a curved S-shaped displacement 7 of the board takes place and also a detachment of fibres 16 on the compression side, i.e. on the underside of the soundboard. In the region of the buckling the adhesion between the fibre laminate 6 and the core material is broken up, and cavities 8 are produced.

The object of the invention is to make further developments to a soundboard of the aforementioned type so that on the one hand by comparison with excellent solid wood soundboards made in the traditional manner it has a markedly improved acoustic quality, in particular has a substantially higher radiated power whilst retaining the usual and desirable timbre of a solid wood soundboard, but that on the other hand by comparison with known soundboards of composite fibre material construction it is distinguished by a construction which is particularly stable under pressure—and at the same time simple to manufacture.

In a soundboard of the aforementioned type this object is achieved according to the invention in that a part of the core plate including the two end regions of the central zone of the core plate has a longitudinal compression strength which is greater than the longitudinal compression strength of the remaining part of the core plate, in particular of the two outer zones of the core plate laterally adjoining the central zone.

Thus according to the invention only the part of the soundboard which is particularly stressed by the string tension is reinforced. This is the central zone of the core plate (which includes the vertical longitudinal central plane of the soundboard), in particular the two end regions of this central zone. This part of the core plate is reinforced in such a way that here by comparison with the remaining regions of the core plate a substantially increased longitudinal compression strength is provided. In this way it is possible, using the least possible additional mass, to achieve the necessary stability of the soundboard, in particular absolute security against the described danger of buckling. The use of a quite small additional mass for the longitudinal reinforcement of the core plate is of crucial importance for achieving a high sound radiation, since the vibration levels of the characteristic vibrations which are crucial for the sound radiation of the instrument are higher as the vibrating mass of the soundboard becomes smaller. By comparison with a construction in which a core plate material is chosen which is sufficiently resistant to buckling (with appropriately high density), the solution according to the invention with the longitudinal reinforcement of the two end regions of the core plate is distinguished by a substantially lower mass and thus a substantially higher sound radiation.

The increase in the longitudinal compression strength of the part of the core plate which is particularly stressed by the string tension can be achieved in different variants according to the invention which are the subject matter of claims 2 to 7 and are explained in greater detail with reference to FIGS. 2*a*, 2*b* and 3*a* to 3*c*.

Soundboards of composite fibre material construction should have not only a high sound radiation but also as far as possible the usual timbre of an excellent solid wood soundboard. The timbre is basically determined by the frequencies and vibrational shapes of the characteristic vibrations which for their part are dependent upon the anisotropy of the velocity of sound of the longitudinal waves (in the case of spruce wood the ratio of the velocity of sound in the longitudinal direction to the velocity of sound in the cross direction of the fibres is approximately 4:1). Therefore in order to achieve the same timbre in a soundboard of composite fibre material construction as in a good wood soundboard it is a matter of producing the said anisotropy.

This object is achieved according to the invention by a special construction of the two fibre laminates provided on the outer faces of the core plate, whereby the longitudinal compression reinforcement of the central zone of the core plate or of the two end regions of this central zone also influences the said anisotropy. Two solutions are the subject matter of claims 8 and 9 and are explained in detail with reference to FIGS. 4 and 5.

FIG. 1*a* is a schematic side elevational view of an instrument incorporating an embodiment of the invention;

FIG. 1*b* is an enlarged view of the detail designated 15 in FIG. 1*a;*

FIG. 2*a* is an elevational view of the core plate;

FIG. 2*b* is a sectional view of the soundboard incorporating the core plate shown in FIG. 2*a;*

FIGS. 3*a,* 3*b*, and 3*c* are views similar to FIG. 2*b*, but illustrating modified embodiments;

Figure 1A:
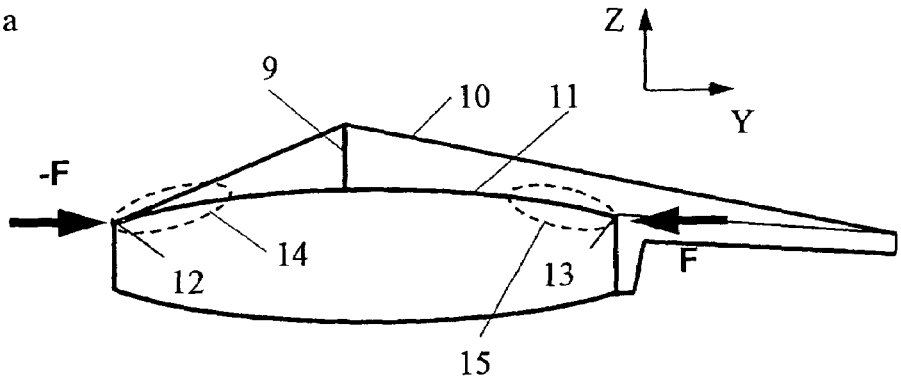
Figure 1B:
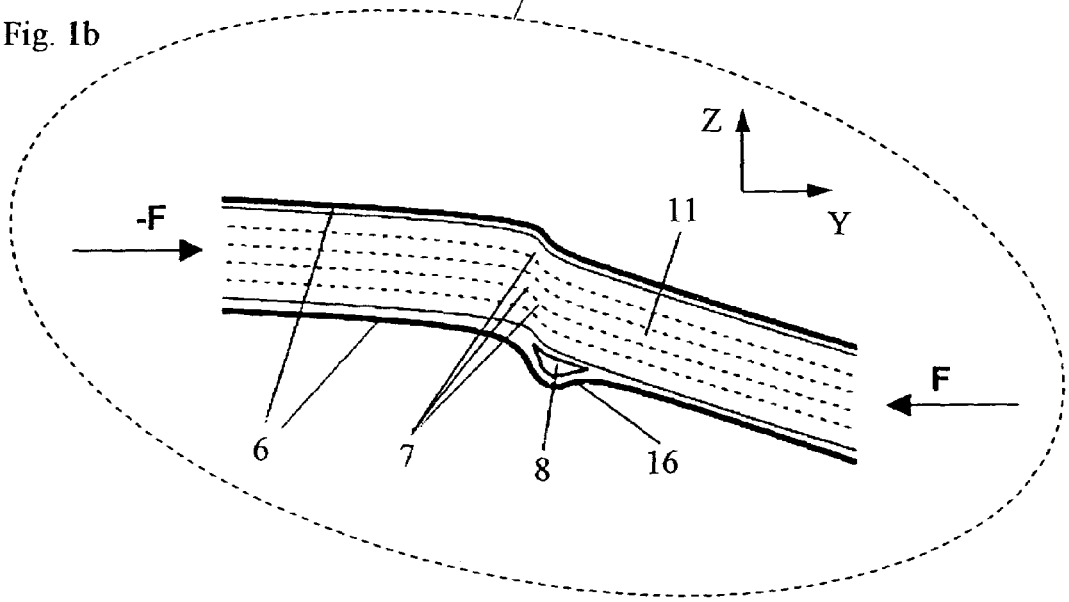
Figure 2A:
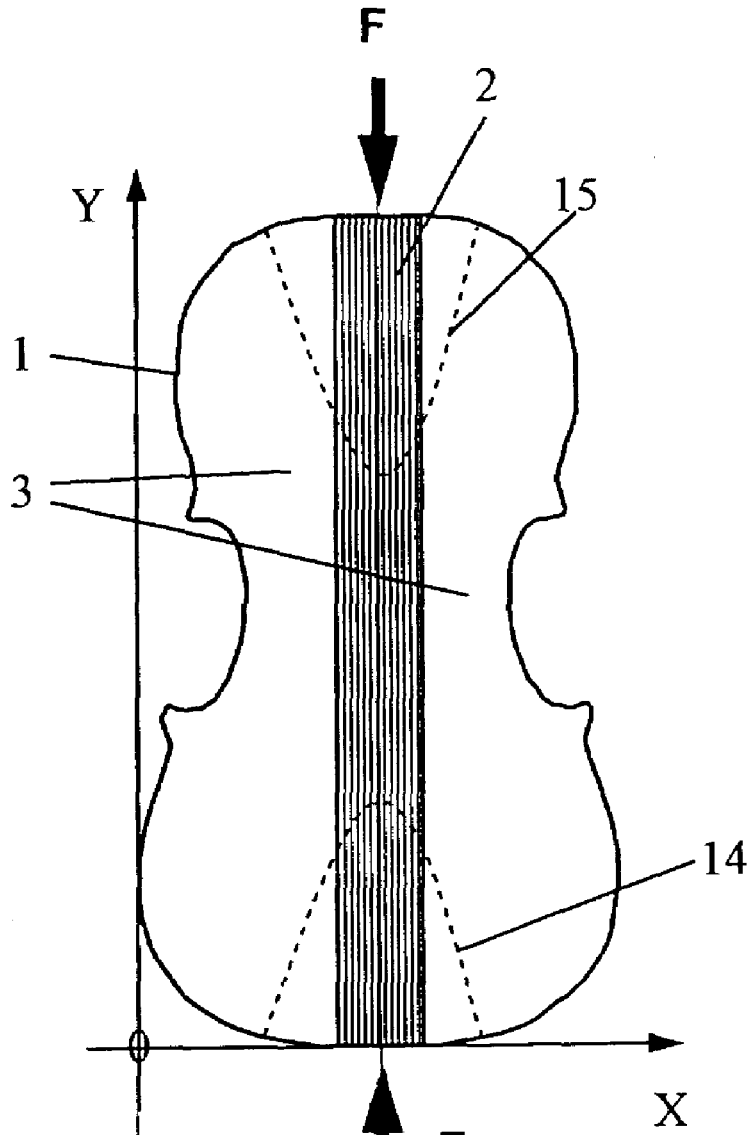
Figure 2B:
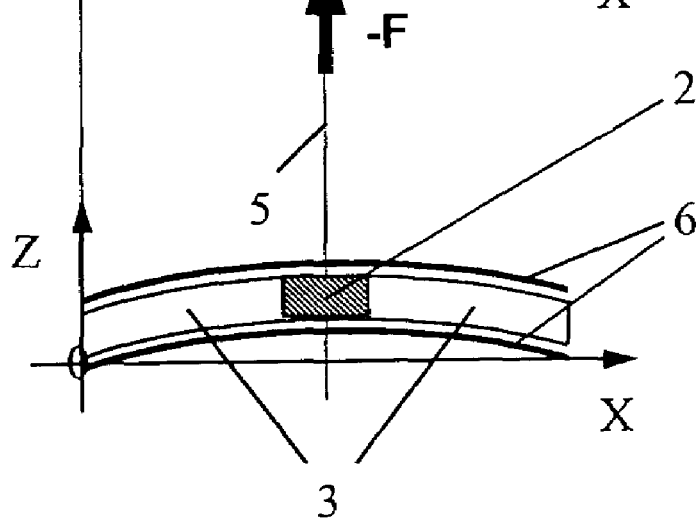

In the first embodiment of the invention illustrated in FIGS. 2*a* and 2*b* the central zone of the core plate comprises a strip 2 of a material with a high longitudinal compression strength, preferably spruce wood. Laterally adjoining the central zone are to outer strips 3 of large surface area which are made from a material with a low density and correspondingly low compression loading, preferably balsa wood or hard foam. The strip 2, which is disposed symmetrically with respect to the vertical longitudinal central plane of the soundboard, occupies a width of 10 to 25%, preferably 14 to 20%, of the total width of the outline of the soundboard. Due to this strip 2 the two end regions 14 15 of the central zone of the soundboard acquire a higher longitudinal compression strength by comparison with the two lateral strips 3, so that the soundboard can reliably absorb the longitudinal compression forces F, −F caused by the string tension and buckling of the soundboard (as illustrated with reference to FIG. 1*b*) is reliably precluded. This considerable increase in the resistance of the soundboard to compression and to buckling is achieved with an acceptably small increase in the vibrating mass of the soundboard.

Figure 3A:
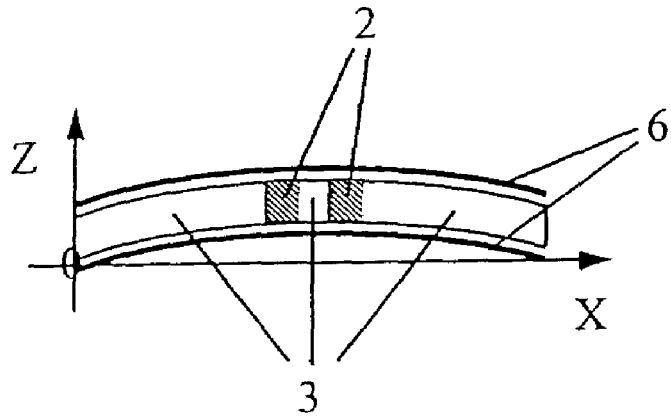
Figure 3B:
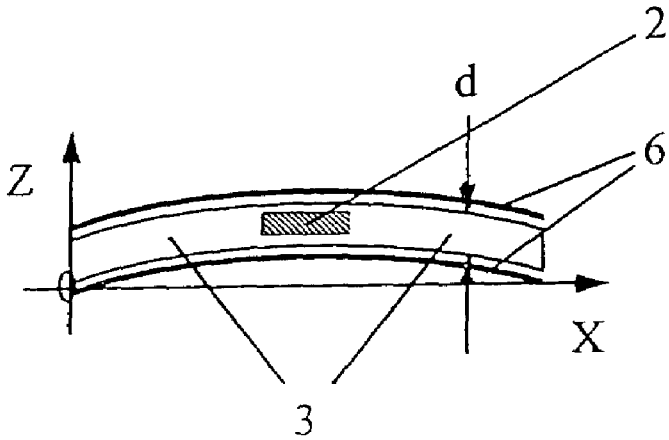
Figure 3C:
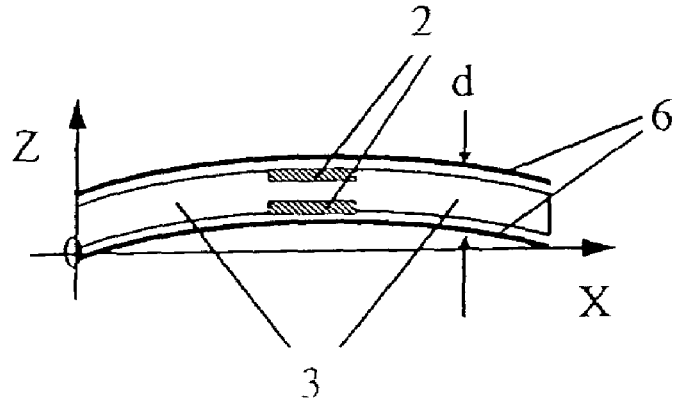

FIGS. 3*a* to 3*c* show three variants of the construction according to FIGS. 2*a* and 2*b:*

According to FIG. 3*a* the central zone of the core plate is reinforced by two segments of a compression-resistant strip 2 which are disposed with reciprocal spacing and preferably symmetrically with respect to the vertical longitudinal central plane of the soundboard. The space between the two segments of the strip 2 is, just like the two outer zones, filled with low-density material (strip 3).

In the embodiment illustrated in FIG. 3*b* the core plate has in the region of the central zone a strip 2 of high longitudinal compression strength, the height of which amounts to only a part of the thickness d of the core plate. This strip 2 is advantageously formed into the core plate in such a way that it is surround on all sides, that is to say also on the upper and lower face, by low-density material (strip 3).

FIG. 3*c* shows an embodiment in which two segments of a strip 2 with a higher longitudinal compression strength are provided spaced one above the other in the central zone of the core plate. Also the total height of these strip segments is less than the thickness d of the core plate. The two segments of the strip 2 are preferably flush with the upper or lower face of the core plate on which the fibre laminates 6 are disposed.

As already mentioned above, care must be taken to ensure that a soundboard of composite fibre material construction has as far as possible the same anisotropy of the velocity of sound of the longitudinal waves as an excellent wood soundboard. Since this anisotropy is to a certain extent already influenced by the measures according to the invention as described above (increasing the longitudinal compression strength in the central zone of the soundboard), it is a matter of achieving the desired value of the anisotropy by an advantageous configuration of the two outer fibre laminates 6. Two suitable possibilities for this are illustrated in FIGS. 4 and 5.

Figure 4:
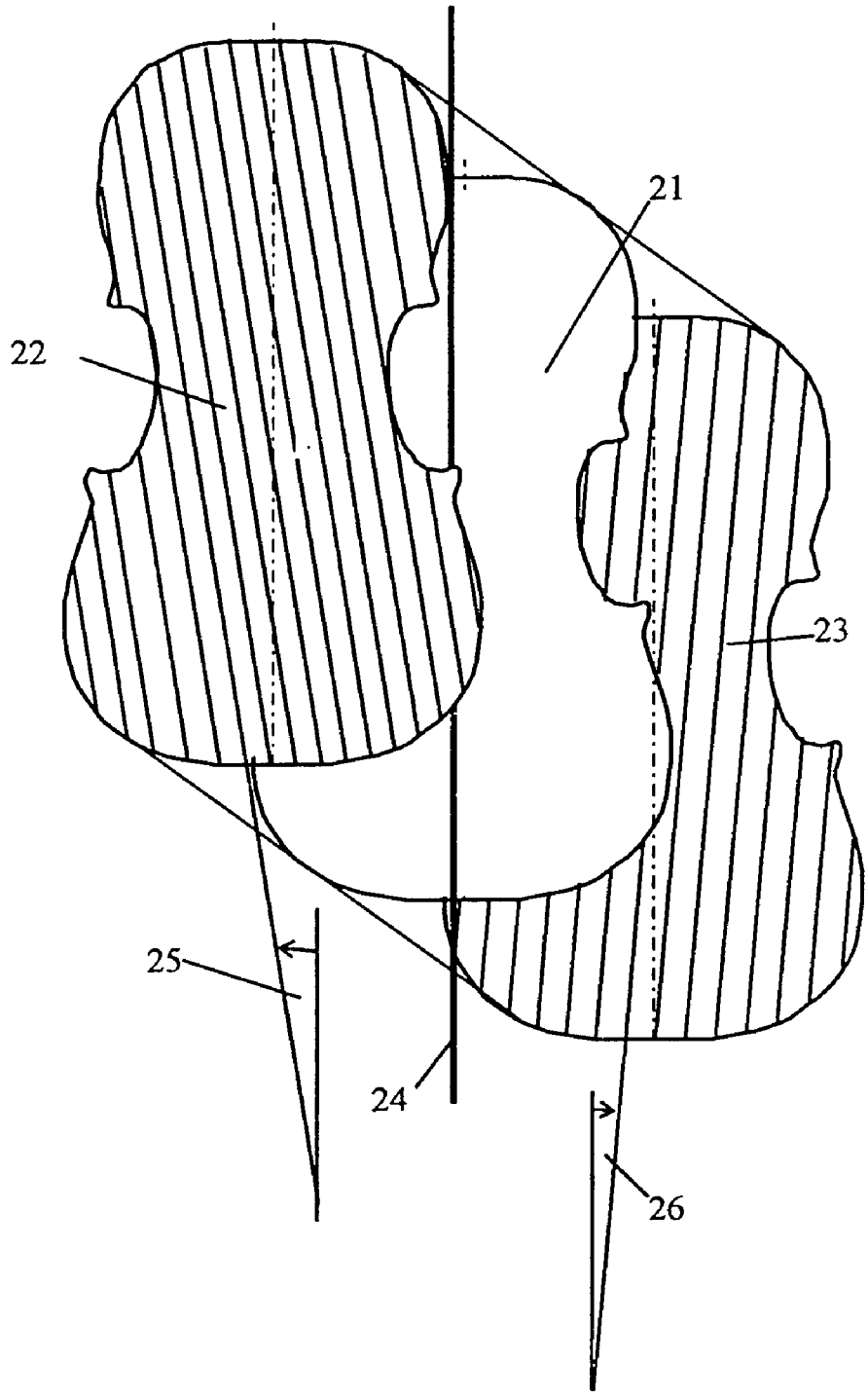
FIG. 4 is an exploded view of a soundboard.

FIG. 4 shows (in a schematic exploded representation) a soundboard of which the central zone has a higher longitudinal compression strength (the means used for this purpose, for example according to FIGS. 2*a*, 2*b*, 3*a* to 3*c*, are not shown in detail in FIG. 4). In FIG. 4 the core plate is denoted by 21 and the two outer fibre laminates are denoted by 22, 23. These fibre laminates 22, 23 each contain a layer of long fibres which are embedded in a carrier material and are disposed parallel to one another within the respective layer. In this case the long fibres of the two fibre laminates 22, 23 extend at different angles 25, 26 respectively—relative to an imaginary vertical longitudinal central plane 24 of the soundboard—and in fact in the illustrated embodiment at opposing and unequal angles. In this way, with a suitable choice of the angles even when only one single layer of long fibres is used per fibre laminate (and thereby with the low mass of the soundboard which is necessary in order to achieve the desired high sound radiation) the required anisotropy of the velocity of sound of the longitudinal waves is achieved.

Figure 5:
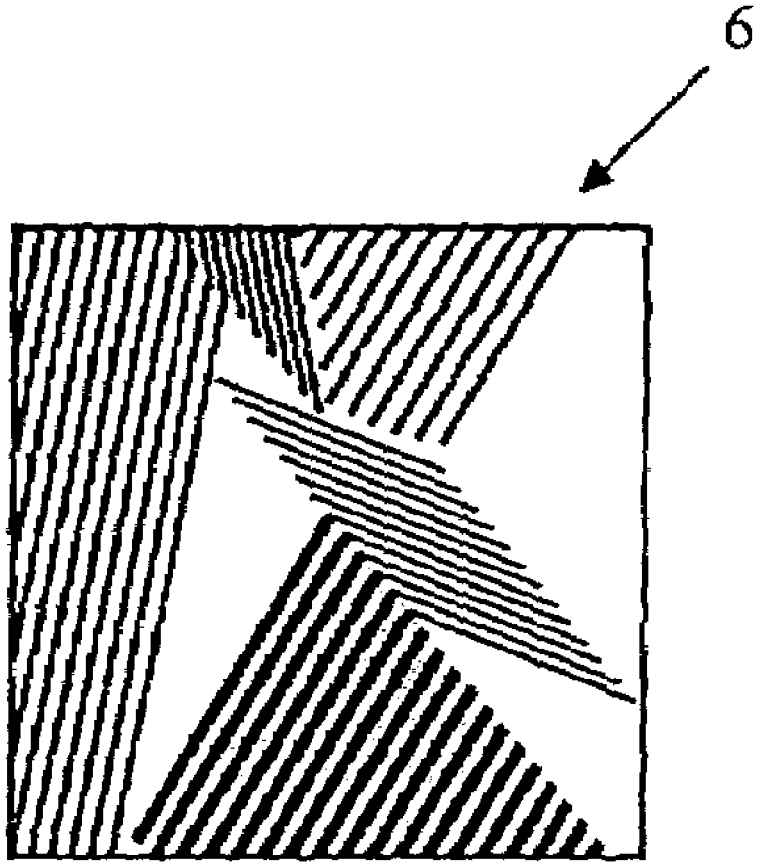
FIG. 5 is an enlargement of a surface section of an outer fibre laminate of a soundboard.

FIG. 5 illustrates a further possibility for how by an appropriate configuration of the two outer fibre laminates a soundboard, of which the central plane has acquired an increased longitudinal compression strength by the means explained, can be constructed in such a way that it has the desired anisotropy of the velocity of sound of the longitudinal waves. FIG. 5 shows a surface segment of a fibre laminate 6 which comprises a plurality of separate individual zones of long fibres applied in one layer like patchwork to the core plate. In each of these zones considered by itself the fibres lie unidirectionally. Considered as a whole, however the longitudinal fibre directions of all zones assume different angles. In this way a multidirectional single-layer fibre laminate is achieved overall. By a suitable choice of the fibre direction in the individual zones the resulting anisotropy of the soundboard (also taking into consideration the influence of the compression reinforcement of the central zone of the soundboard) can be set very precisely to the desired value.

The invention claimed is:

1. Soundboard of composite fibre material construction for acoustic stringed instruments, in particular for use as at least one of the two soundboards of the resonant body of bowed stringed instruments, comprising a core plate and a fibre laminate (6) which is provided on at least one of the two outer faces of the core plate and is composed of long fibres embedded in a carrier material, the core plate having a lower average density than the fibre laminate, characterised in that a part of the core plate including the two end regions (14, 15) of the central zone of the core plate has a longitudinal compression strength which is greater than the longitudinal compression strength of the remaining part of the core plate, in particular of the two outer zones of the core plate laterally adjoining the central zone.

2. Soundboard as claimed in claim 1, in which the core plate comprises at least three longitudinally-oriented strips (2, 3) of differing longitudinal compression strength, wherein the strip (2) with the highest compression strength forms the central zone of the core plate and is preferably made from spruce wood, whilst the two outer strips (3) laterally adjoining the central zone are preferably made from balsa wood and/or hard foam.

3. Soundboard as claimed in claim 2, in which the strip (2) which forms the central zone of the core plate occupies a width of 10 to 25%, preferably 14 to 20%, of the total width of the outline of the soundboard.

4. Soundboard as claimed in claim 2, in which the strip (2) with the highest longitudinal compression strength is composed of two reciprocally spaced segments, the space between the two segments being filled with a low-density material.

5. Soundboard as claimed in claim 4, in which the two segments of the strip (2) are disposed spaced alongside one another, symmetrically with respect to the vertical longitudinal central plane of the soundboard.

6. Soundboard as claimed in claim 4, in which the two segments of the strip (2) are disposed spaced one above the other in the central zone of the core plate.

7. Soundboard as claimed in claim 2, in which the core plate has in the region of the central zone at least one strip (2) with a high longitudinal compression strength which extends only over a part of the thickness (d) of the core plate.

8. Soundboard as claimed in claim 1, in which the two fibre laminates (22, 23) provided on the outer faces of the core plate each contain a layer of long fibres which are embedded in a carrier material and are disposed parallel to one another within the respective layer, whereby the long fibres of the two layers extend at different angles (25, 26)—relative to an imaginary vertical longitudinal central plane (24) of the soundboard—preferably at opposing and unequal angles.

9. Soundboard as claimed in claim 1, in which the two fibre laminates provided on the outer faces of the core plate each contain a layer of long fibres which are embedded in a carrier material and are disposed multidirectionally within the respective layer.

* * * * *